US010297434B2

(12) United States Patent
McIntosh

(10) Patent No.: US 10,297,434 B2
(45) Date of Patent: May 21, 2019

(54) METHOD FOR EXTRACTING MASS INFORMATION FROM LOW RESOLUTION MASS-TO-CHARGE RATIO SPECTRA OF MULTIPLY CHARGED SPECIES

(71) Applicant: Microsaic Systems PLC, Woking, Surrey (GB)

(72) Inventor: Alexander Iain McIntosh, Woking (GB)

(73) Assignee: Microsaic Systems PLC, Woking, Surrey (GB)

( * ) Notice: Subject to any disclaimer, the term of this patent is extended or adjusted under 35 U.S.C. 154(b) by 0 days.

(21) Appl. No.: 16/084,721

(22) PCT Filed: Apr. 25, 2017

(86) PCT No.: PCT/EP2017/059738
§ 371 (c)(1),
(2) Date: Sep. 13, 2018

(87) PCT Pub. No.: WO2017/202561
PCT Pub. Date: Nov. 30, 2017

(65) Prior Publication Data

US 2019/0103259 A1 Apr. 4, 2019

(30) Foreign Application Priority Data

May 24, 2016 (GB) ..... 1609069.8

(51) Int. Cl.
*H01J 49/36* (2006.01)
*H01J 49/00* (2006.01)
*H01J 49/16* (2006.01)

(52) U.S. Cl.
CPC ..... *H01J 49/0036* (2013.01); *H01J 49/165* (2013.01)

(58) Field of Classification Search
USPC ..... 250/282
See application file for complete search history.

(56) References Cited

U.S. PATENT DOCUMENTS 5,072,115 A 12/1991 Zhou
5,130,538 A 7/1992 Fenn et al.
5,300,771 A 4/1994 Labowsky
5,352,891 A * 10/1994 Monnig ..... H01J 49/0036 250/282
5,440,119 A 8/1995 Labowsky
5,686,726 A * 11/1997 Fenn ..... B01D 59/44 250/281

* cited by examiner

*Primary Examiner* — Phillip A Johnston
(74) *Attorney, Agent, or Firm* — Stephen T. Scherrer; Monique A. Morneault; Scherrer Patent & Trademark Law, P.C.

(57) ABSTRACT

An apparatus and method for extracting mass information from low resolution mass-to-charge ratio spectra of multiply charged species is described. Curve fitting is performed using the logarithm of the mass to charge data, which deemphasizes noise induced disturbances.

12 Claims, 16 Drawing Sheets

METHOD FOR EXTRACTING MASS INFORMATION FROM LOW RESOLUTION MASS-TO-CHARGE RATIO SPECTRA OF MULTIPLY CHARGED SPECIES

FIELD OF THE INVENTION

The present invention relates to mass spectrometry and particularly to an apparatus and method for extracting mass information from low resolution mass-to-charge ratio spectra of multiply charged species.

BACKGROUND

The use of electrospray ionisation in mass spectrometry has become commonplace and in particular its use in the study of large biomolecules has become ubiquitous. Although advantageous, as it allows the study of labile species in their complete form, multiple charging can lead to complex mass-to-charge ratio spectra. Since these spectra are observations of ion counts at different mass-to-charge ratios, this multiple charging can result in the parent molecule exhibiting multiple peaks making the parent mass difficult to determine. Consequently a number of methods have been developed to garner information about the mass of the parent molecule from these complex spectra. To extract this information, knowledge regarding the charge states of the observed parent molecule ions is required. Using high resolution spectra (those with isotopic resolution) the assignment of these charge states can be easily inferred from the separations between adjacent isotopic peaks. In low resolution mass-to-charge ratio spectra (those without isotopic resolution) the extraction of the parent molecule mass is not as straightforward.

The use of low resolution mass spectrometry for the study of large molecules such as biomolecules does present certain advantages. These advantages stem from the ability to produce lower resolution mass spectrometry instruments at reduced cost and the miniaturisation of such instruments is also easier. These benefits make the use of low resolution instruments for on-line and at-line analysis very appealing. This use of mass spectrometry presents additional challenges as sampling is often from a range of environments with little or no sample preparation. A result of this is that mass-to-charge ratio spectra can appear noisy and can contain extraneous peaks caused by solvent clusters and ion adducts originating from the sample media. The extraction of parent molecule masses in these scenarios can therefore be very challenging. In particular, techniques relying on peak picking can easily fail when strong extraneous peaks and poor signal to noise are characteristics of the mass-to-charge ratio spectra. In addition, peak picking by its nature results in the reduction of a peak to a single mass-to-charge ratio. Peak picking techniques can therefore lead to the misrepresentation of peaks with shoulders or any form of asymmetry. Other deconvolution methods can be strongly influenced by background noise, leading to the generation of artefact peaks that do not represent the true mass of the parent molecule.

The use of cheap and miniaturised low resolution instruments for applications such as on-line and at-line monitoring also presents additional requirements; use in these environments inevitably results in the transition from use by skilled practitioners to users with lower skills and experience in mass spectrometry. As a result any methodology used to extract parent molecule masses from multiply charged mass-to-charge ratio spectra should be easy to use and require minimal user input.

A number of methods for extracting mass information from mass-to-charge ratio spectra with no isotopic resolution have been implemented. These are discussed below:

Zhang and Marshall describe a method 'ZScore' in the Journal of the American Society for Mass Spectrometry, vol. 9, 225-233 (1998). This method utilises peak picking and a scoring system based on the logarithm of the signal to threshold ratio. The ratio is calculated from background noise and a user defined signal to noise ratio. As this method is dependent upon peak picking, it is subject to the disadvantages of peak picking outlined previously. The need for the user to define a signal to noise ratio and a range of mass-to-charge ratios to calculate background noise is another disadvantage of this system. In particular, useful information may be lost if the noise level is set at an inappropriate level.

Morgner and Robinson describe the method 'Massign' in Analytical Chemistry, vol. 84, 2939-2948 (2012). Like the ZScore method, described above, this method is dependent upon accurate peak picking and user input in the form of two threshold levels. In addition, peaks with poor separation have to be identified manually for inclusion in the calculations. The method is therefore not well suited to extracting parent masses from low quality mass-to-charge ratio spectra.

In the International Journal of Mass Spectrometry, vol. 290, 1-8 (2010) and Analytical Chemistry, vol. 77, 111-119 (2005) Maleknia et al. describe a method 'eCRAM' which utilises the unique ratio of integers from charge states to calculate the charge states of peaks in a low resolution mass-to-charge ratio spectrum. This method is also dependent on clearly identifying peaks in the spectrum to be analysed.

Winkler describes a method 'ESIprot' in Rapid Communications in Mass Spectrometry, vol. 24, 285-294 (2010) which uses peaks observed in the mass-to-charge ratio spectrum to calculate the mass of the species at differing charge states. The correct charge states are identified by calculating the set of charge states which yield the lowest standard deviation with Bessel's correction. The performance of this method is also dependent upon the ability to clearly identify peaks of interest in the mass spectrum. The assumption that any peaks identified and used in the method are from a consecutive series of multiply charged ions is also a serious limitation of this method.

Mann et al. describe two methods in Analytical Chemistry, vol. 61, 1702-1708 (1989) which are also described in U.S. Pat. No. 5,130,538. The first method is an averaging algorithm which uses relative peak positions to infer charge states and calculate the mass of the parent molecule. This method is reliant on peak picking and has the potential to be strongly influenced by noise and extraneous peaks. A second method described in these two sources is a deconvolution algorithm. This method uses a transformation function to evaluate trial values of the parent molecule mass. This transformation function is calculated from the distribution function of the ion counts in the mass-to-charge ratio spectrum. This deconvolution method benefits from not being reliant on peak picking but, as they demonstrate in both references, is strongly influenced by background noise. This can result in the production of erroneous results, in the form of multiples or fractions of the parent molecule mass, appearing in the de-convoluted spectrum. An increase in background noise with mass in the de-convoluted spectrum is an additional undesirable artefact of this method.

A method utilising a deconvolution algorithm is also described in Analytical Chemistry, vol. 66, 1877-1883 (1994) and U.S. Pat. No. 5,352,891. Unlike the Mann algorithm described above ion counts are multiplied to together to form a multiplicative correlation algorithm rather than added together. This change in methodology reduces the impact of background noise and the introduction of artefact peaks. However, this multiplicative technique can be strongly disadvantaged by the presence of a single ion count equal to zero or an abnormally high ion count. The inclusion of this zero ion count to the calculation will lead to complete suppression of the signal in the de-convoluted spectrum. Similarly, the inclusion of a single large ion count (e.g. resulting from an adduct ion or noise) can unduly influence the signal in the de-convoluted spectrum.

The forward working maximum entropy method, first described by Reinhold et al. in the Journal of the American Society for Mass Spectrometry, vol. 3, 207-215 (1992), is advantageous as it has added discrimination against artefact peaks. However, the method can be computational expensive and extensive a priori knowledge of relative intensities and peak shapes in the mass-to-charge ratio spectrum is required for the effective extraction of the parent molecule mass.

What is required is a robust methodology which can extract the mass of multiply charged parent molecules from poor quality low resolution mass-to-charge ratio spectra, i.e. those without isotopic resolution, low signal to noise and containing extraneous adduct peaks. In addition, this methodology should not be reliant on the use of peak picking techniques, be strongly influenced by background noise and be prone to the generation of artefact peaks. The methodology should also require minimal user input and a priori knowledge; thereby allowing the successful implementation of the method by users who are not expert practitioners of mass spectrometry.

SUMMARY

These and other problems are addressed in accordance with the present teaching by a method and apparatus that can extract mass information from low resolution mass-to-charge ratio spectra of multiply charged species.

In one aspect of the present teaching a method is provided which involves the initial ionisation of a polyatomic parent molecule to produce a population of multiply charged ions of the parent molecule. For each ion, the number of charges present defines the charge state of that ion, and each charge state consists of a sub-population within the population of ions. Analysis of these sub-populations yields a mass-to-charge ratio spectrum; the intensity at each mass-to-charge ratio being a direct representation of the population of each charge state.

After generation of the mass-to-charge ratio spectrum, the present teaching may employ pre-processing steps to abate any noise and reduce the baseline of the obtained mass-to-charge ratio spectrum to zero. Following pre-processing the mass-to-charge ratio spectrum is transformed to a new representation of the spectrum using the function below:

$$X_j = \ln\left(\frac{I_j}{S_j}\right)$$

Where X is the new representation of the mass-to-charge ratio spectrum, I corresponds to the intensity in the pre-processed input mass-to-charge ratio spectrum and S is a mean centred representation of I. This new representation of the mass-to-charge ratio spectrum can be transformed to produce a mass spectrum with all species at zero charge. Equally it will be appreciated that a mass-to-charge ratio spectrum with all species singly charged can be produced to the same effect.

While it is not intended to limit the present teaching to the zero charge example, for the purposes of assisting in an understanding of the present teaching, the zero charge state representation will be used in the detailed description and is calculated using the function below:

$$F(M, n'_{max}) = \sum_{n=1}^{n=n'_{max}} X\left(\frac{M}{n} + m_a\right)$$

For differing trial values of M within a pre-defined range the values of the signal enhanced mass-to-charge ratio spectrum (X) are summed to the maximum charge state $n'_{max}$. By iterating to different values of the maximum charge state $n'_{max}$ the value of $F(M, n'_{max})$ is optimised to prevent overfitting and the appearance of artefacts in the zero charge mass spectrum.

A function for evaluating a singly charged mass spectrum may be derived from the above zero charge function and used to identify a range of singly charged mass values. A singly charged state representation may be calculated using the function below:

$$F(M, n'_{max}) = \sum_{n=1}^{n=n'_{max}} X\left(\frac{M - m_a}{n} + m_a\right)$$

The above equations may be further generalised by use of the function below:

$$F(M, n'_{max}) = \sum_{n=1}^{n=n'_{max}} X\left(\frac{M - zm_a}{n} + m_a\right)$$

It will be appreciated that the above zero charge function can be obtained by equating z to 0 in the general function, while the above function for the singly charged state representation can be obtained by equating z to 1 in the general function.

The zero charge state representation is most commonly used and for clarity will be used throughout the detailed description. In the singly charged representation the mass of the adduct ion is also taken into account. This representation is of utility when direct comparison, with unprocessed mass-to-charge spectra of singly charged species from ESI-MS experiments, is required.

Such a method advantageously analyses the complete mass-to-charge ratio spectrum and in this way all components are treated equally and therefore there is no reliance on peak picking methods and a priori knowledge of noise levels. The use of the transformed mass-to-charge ratio spectrum prevents background noise from unduly influencing the output, a phenomena seen with other methods in the prior art. Consequently this methodology allows for the effective extraction of parent molecule masses from low quality and noisy mass-to-charge ratio spectra with minimal user input and a priori knowledge. Accordingly, a first aspect of the present teaching provides a method for extracting mass information from low resolution mass-to-charge ratio spectra of multiply charged species to identify a mass of a polyatomic parent molecule within the multiply charged species, the method comprising the steps of:

receiving from a mass spectrometer a data set indicative of a population of multiply charged ions, the number of charges on each ion defining the charge state of that ion, each charge state consisting of a sub-population of ions within said population of ions;

using the data set indicative of a population of multiply charged ions to produce an input mass-to-charge ratio spectrum, the sub-populations of each charge state being represented by intensities in the mass-to-charge ratio spectrum;

processing the input mass-to-charge ratio spectrum to provide a signal enhanced mass-to-charge ratio spectrum, the signal enhanced mass-to-charge ratio spectrum being generated from a logarithm of the quotient of said mass-to-charge ratio spectrum and a smoothed representation of said mass-to-charge ratio spectrum;

using a defined charged mass spectrum to identify a range of defined charged mass values within which to search for a mass of the polyatomic parent molecule;

generating for each mass within said range of defined charged mass values a summation equal to the addition of values in the signal enhanced mass-to-charge ratio spectrum that correspond to said mass at sequential charge states up to a maximum charge state using the function:

$$F(M) = \sum_{n=1}^{n=n_{max}} X\left(\frac{M - zm_a}{n} + m_a\right)$$

Where M is any defined mass within said range of defined charged mass values; $m_a$ is the mass of the charge carrying adduct; z is the order of the defined charged mass spectrum and X is a distribution function of the signal enhanced mass-to-charge ratio spectrum; and using said summation values to determine the mass of a polyatomic parent molecule.

In a further development of the present teaching, using said summation values to determine the mass of a polyatomic parent molecule comprises normalizing the values from said summations across the range of summations to determine the mass of the parent molecule.

In a further development of the present teaching, the mass of the charge carrying adduct, $m_a$, is set to equal one, representing a proton mass.

In a further development of the present teaching, the signal enhanced mass-to-charge ratio spectrum is generated from the function:

$$X_j = \ln\left(\frac{I_j}{S_j}\right) \qquad \text{Equation 1}$$

Where X represents the signal enhanced mass-to-charge ratio spectrum, I corresponds to an intensity in the input mass-to-charge ratio spectrum and S is a smoothed representation of the input mass-to-charge ratio spectrum.

In a further development of the present teaching, for each mass within the defined range of defined charged mass values, the method further comprises:

calculating summations up to differing values of a maximum charge state;

using of the values from said summations up to different values of the maximum charge state to determine the molecular weight of the parent molecule.

In a further development of the present teaching, the method further comprises spectral pre-processing of the input mass-to-charge ratio spectrum prior to forming the signal enhanced mass-to-charge ratio spectrum.

In a further development of the present teaching, the spectral pre-processing is selected from at least one of smoothing and/or baseline subtraction.

In a further development of the present teaching, the multiply charged species are generated by electrospray ionisation.

In a further development of the present teaching, the method further comprises ionising a polyatomic parent molecule within a mass spectrometer source to produce the input mass-to-charge ratio spectrum.

In a further development of the present teaching, the defined charge mass spectrum is a zero charge mass spectrum with all identified species having a zero charge value.

In a further development of the present teaching, the defined charge mass spectrum is a singly charged mass spectrum used to identify a range of singly charged mass values.

According to a second aspect of the present invention, there is provided a mass spectrometer comprising an electrospray ionisation source and a detector, the detector configured to generate an output indicative of a population of multiply charged ions generated by the ionisation source, the number of charges on each ion defining the charge state of that ion, each charge state consisting of a sub-population of ions within said population of ions, the spectrometer further comprising a processor configured to carry out the above method.

These and other aspects of the present teaching will now be described with reference to the following Figures which are provided to assist in an understanding of the present teaching but should not be construed as limiting in any fashion.

DESCRIPTION

Figure 1:
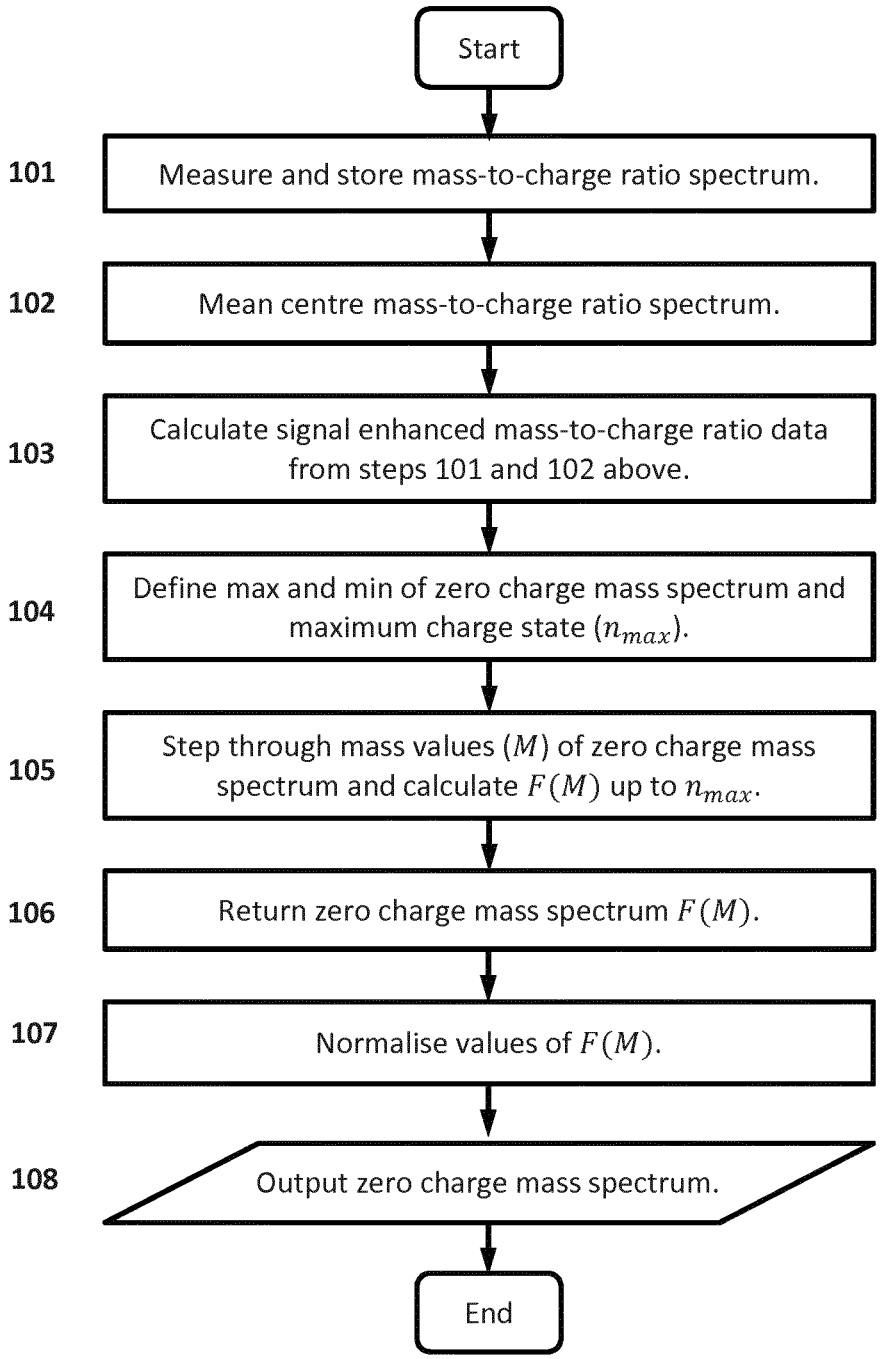
FIG. 1 is a flowchart of processing steps used in a first aspect of the present teaching.

FIG. 1 shows a flow diagram representing a method for extracting mass information from low resolution mass-to-charge ratio spectra in accordance with the present teaching.

In step 101 a mass spectrum is measured using conventional mass spectrometry techniques and stored in the form of a mass-to-charge ratio spectrum. As will be appreciated by those of ordinary skill in the art, such techniques allow sub-populations of the different charge states of the parent molecule to be represented as ion counts at different mass-to-charge ratios.

Figure 2:
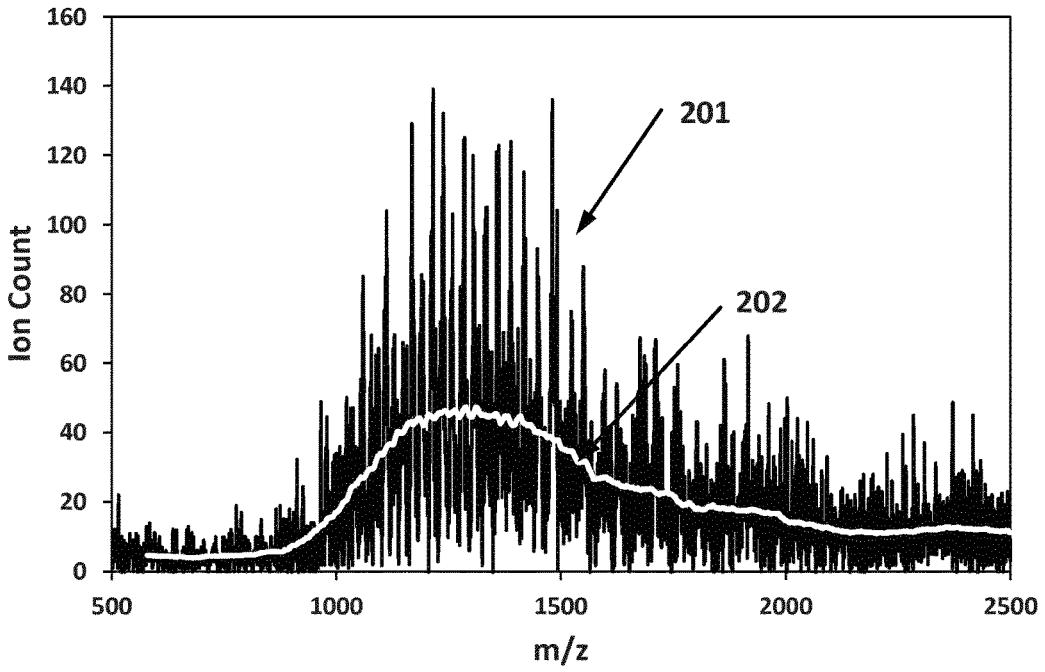
FIG. 2 is an example of the implementation of step 102 in FIG. 1 on a mass-to-charge ratio spectrum of bovine serum albumin.

At step 102 smoothing techniques are employed on the data to represent the trend from the input mass-to-charge ratio spectra. The type of smoothing technique may vary, for example smoothing may be undertaken using a centred moving average to effectively mean centre the data. In alternative arrangements, other moving averages including, but not limited to, the mean can be utilised for smoothing or centring the data. Other smoothing methods such as exponential smoothing methods can also be implemented. FIG. 2 demonstrates the implementation of Step 102 on an input mass-to-charge ratio spectrum of bovine serum albumin. In this exemplary data set, the mass-to-charge ratio spectrum of bovine serum albumin is represented by the "noisy" signal 201 and 202 illustrates the effect of a smoothing algorithm, in this aspect using mean centred data, on the data of signal 201.

At step 103 a mass-to-charge ratio spectrum is generated that enhances the presence of peaks and reduces the influence of noise, hereafter called the 'signal enhanced mass-to-charge ratio spectrum'. Generation of this spectrum is achieved by taking the logarithm of the quotient of data from the input spectrum (from step 101)—the data set represented by the data 201- and the mean centred spectrum generated in step 102:

$$X_j = \ln\left(\frac{I_j}{S_j}\right) \qquad \text{Equation 1}$$

Figure 3:
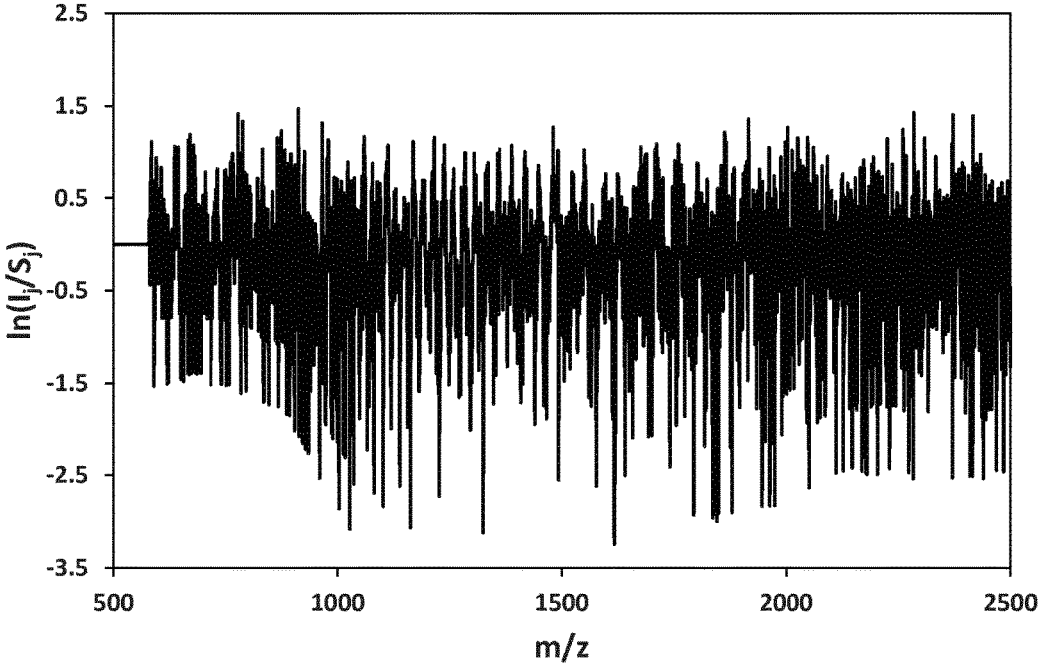
FIG. 3 is an example of the implementation of step 103 in FIG. 1 to produce the signal enhanced mass-to-charge ratio spectrum.

In this equation, X represents the signal enhanced mass-to-charge ratio spectrum, I corresponds to the intensity in the input mass-to-charge ratio spectrum (201) and S is the mean centred representation of I (202). Typically, this step would involve use of the natural logarithm. In alternative arrangements, logarithms of any base may be used to similar effect. A demonstration of application of the processing of this step on the data presented in FIG. 2 is shown in FIG. 3. From FIG. 3 it is evident that the use of the quotient of I and S ensures that the contributions from each peak are more even and not unduly influenced by a small number of very intense peaks which could for example be attributable to a single adduct peak or noise artefact. The technical effect achieved by this logarithmic transformation is that the net contribution from the summation of noise and local minima between unresolved peaks is negated. This processing step enables all the data in the input spectra to be used without a reliance on a priori peak picking. The output of X can equally be represented by a set of data points in a data array.

In step 104, the maximum and minimum of the zero charge spectrum that will be produced in step 108 are defined. These values can be inferred from the maximum and minimum of the input spectrum from step 101. In this step, the value of the maximum charge state that is to be assessed in step 108 is also defined—$n_{max}$. In accordance with this aspect of the present teaching, $n_{max}$ is calculated from the maximum and minimum of the zero charge spectrum, as defined in step 104, and the range of the mass-to-charge ratio spectrum that is used in step 101. In alternative arrangements, $n_{max}$ can be defined by the user if specific user optimisation of the output is required. As will be apparent from the discussion below with reference to Equation 3, such optimisation can be effected automatically. In other arrangements $n_{max}$ may be predefined as a constant value within the processing routine. Step 104 is shown in the arrangement of FIG. 1 as following steps 101 to 103. Alternative processing routines employed within the context of the present teaching would allow step 104 to be undertaken at any point prior to step 105.

At step 105 a function F(M) is evaluated for the range of zero charge mass values defined in step 104 by using:

$$F(M) = \sum_{n=1}^{n=n_{max}} X\left(\frac{M}{n} + m_a\right) \qquad \text{Equation 2}$$

In equation 2, M is any zero charge mass within the range defined in step 104. The variable $m_a$ is the mass of the charge carrying adducts, and X is the distribution function of the signal enhanced mass-to-charge ratio spectrum evaluated in step 103.

Approximating the series up to an appropriate value of $n_{max}$ reduces computational time. Typically the mass of the adduct ion ($m_a$) is set to equal one, representing a proton, but alternative arrangements could set $m_a$ to any value appropriate to the most common adduct ion and it will be appreciated that the actual choice of value for $m_a$ will depend on the specifics of the methodology and accuracy required. In this way, different methodologies may require $m_a$ to be set to different values and this would require some a priori knowledge of the sample being investigated.

By using the signal enhanced mass-to-charge ratio spectrum, which contains a logarithmic function, the summation in F(M) will be enhanced when M corresponds to the mass of the parent molecule and reduced when M does not. If M corresponds to the mass of the parent molecule the values of $$\left(\frac{M}{n}+m_a\right)$$

will coincide with peaks in the original mass-to-charge ratio spectrum and X will yield a positive value. When M does not correspond with the mass of the parent molecule the values of $$\left(\frac{M}{n}+m_a\right)$$

will coincide with noise or minima in the original mass-to-charge ratio spectrum and the net contribution to the sum will be negative. The use of the signal enhanced mass-to-charge ratio spectrum (X) for the evaluation of F(M) also means that there is a reduction in artefact peaks at multiple values of the parent molecule mass since superfluous values of X from multiple values of M actually negatively impact the value of F(M). This is in contrast to a simple summation of the intensities (I) where additional sampling of the background can result in multiples of the parent molecule mass being accentuated and an increase in baseline with increasing M.

Figure 4:
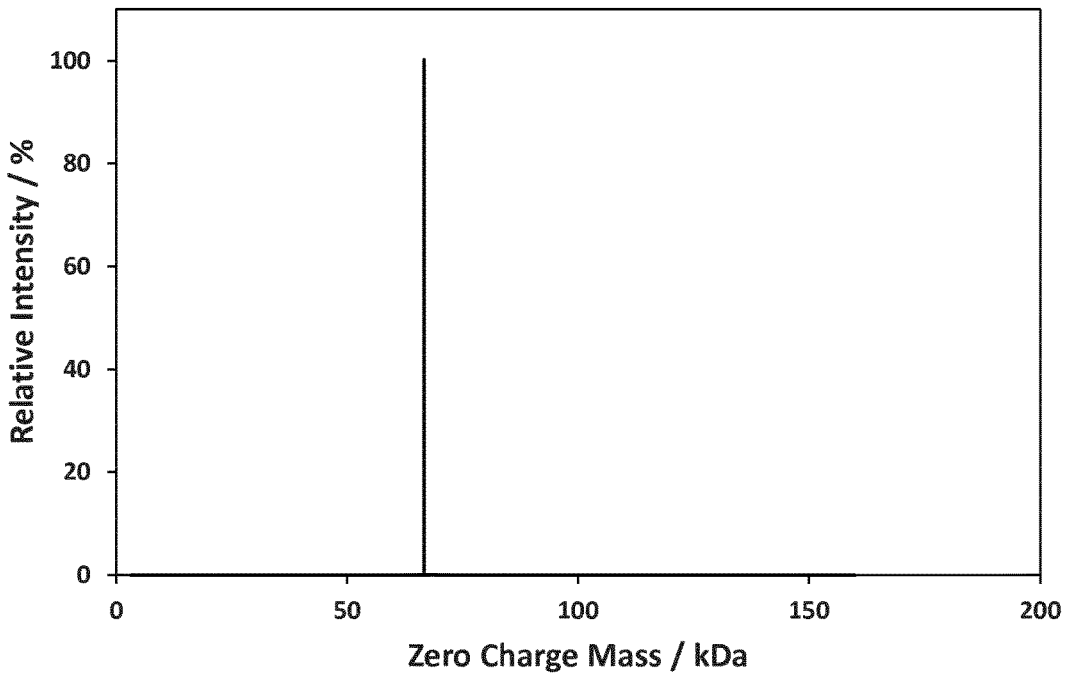
FIG. 4 is an example of a zero charge spectrum generated using the technique generally described with reference to FIG. 1 on the mass-to-charge ratio spectrum presented in FIG. 2.

Once F(M) has been evaluated a zero charge spectrum can be produced in step 106. Values of F(M) can then be normalised in step 107 to produce an output which is more manageable or understandable for the end user, depending on their level of expertise. The zero charge spectrum for the data in FIG. 2 when processed using the method of FIG. 1 is shown in FIG. 4. It will be appreciated that this presentation of the data analysis is only one of a variety of different techniques that could be employed; for example in alternative arrangements the output may be in the form of a table of mass values or simply the value of a single mass.

Due to the summation of logarithms used in this method the height of the peaks generated by this method cannot be used as a quantitative measure of species present. However, data can be normalised against the highest value of F(M) to give an output that is easier to interpret. Once this method has yielded the mass of the parent molecule being investigated, other quantitative data can be easily extracted from the original mass-to-charge ratio spectrum. For example, using the mass of the parent molecule appropriate mass-to-charge ratios can be calculated and the amplitudes at these values in the original mass-to-charge ratio spectrum can be summed. It will be appreciated therefore that a methodology per that of FIG. 1 advantageously provides a user with advance information about the nature of the molecules being investigated and this information can then be used in more detailed processing steps.

It will be appreciated that the above method for extracting mass information from low resolution mass-to-charge ratio spectra in accordance with the present teaching may be performed so as to output a singly charged spectrum at step 108.

For example, in step 104, the maximum and minimum of the singly charged spectrum are defined. The function F(M) may then be evaluated in step 105 for a range of singly charged mass values defined in step 104, by using:

$$F(M)=\sum_{n=1}^{n=n_{max}} X\left(\frac{M-m_a}{n}+m_a\right) \qquad \text{Equation 2a}$$

In equation 2a, M is any singly charged mass within the range defined in step 104. The variable $m_a$ is the mass of the charge carrying adducts, and X is the distribution function of the signal enhanced mass-to-charge ratio spectrum evaluated in step 103.

A singly charged spectrum may be produced in step 106 of FIG. 1 following the evaluation of F(M) according to Equation 2a. Values of F(M) may be normalised in step 107 so as to produce a singly charged mass spectrum output in step 108.

The zero and singly charged representations may be further generalised. In this generalised example, maximum and minimum of the zero or singly charged spectra are defined in step 104. The function F(M) may be evaluated in step 105 for both zero and singly charged mass values defined in step 104, by using:

$$F(M)=\sum_{n=1}^{n=n_{max}} X\left(\frac{M-zm_a}{n}+m_a\right) \qquad \text{Equation 2b}$$

The zero charged representation (equation 2) can be obtained by equating z to 0 and the singly charged representation (equation 2a) can be obtained by equating z to 1.

In Equation 2b, M is any zero or singly charged mass within the range defined in step 104. The variable $m_a$ is the mass of the charge carrying adducts, z the order of the spectrum (with z=0 for the zero charge representation and z=1 for the singly charged representation) and X is the distribution function of the signal enhanced mass-to-charge ratio spectrum evaluated in step 103.

A zero or singly charged spectrum may be then produced in step 106 of FIG. 1 after the evaluation of F(M) according to Equation 2b. Values of F(M) may be normalised in step 107 so as to produce a z-charged mass spectrum output in step 108.

In a modification to the arrangement of FIG. 1, steps 101 to 104 of FIG. 1 are retained but additional processing of that data set is then employed. An example of this modification is described with reference to the flowchart in FIG. 5 where steps 501 to 504 are identical to steps 101 to 104 discussed previously. Steps 505 to 509 represent additional optimisation techniques that may be introduced to improve the accuracy of the determined mass of the parent molecule and to remove any difficulty in assigning $n_{max}$.

At step 505 the temporary parameter $n'_{max}$ is defined and initially set to equal one.

As outlined with reference to FIG. 1, use of the signal enhanced mass-to-charge ratio spectrum is beneficial as the net result from sampling the background or minima is a negative contribution to the summation. This means that as $n_{max}$ increases and the background becomes over sampled the value of F(M) will decrease in value. Contrasting this to a simple summation of the intensities from the input mass-to-charge ratio spectra (I) it will be appreciated that such techniques employ an oversampling of the background at high values of $n_{max}$ which leads to increasing values of F(M). Using this insight, in the modification that is exemplified with reference to FIG. 5 this may be advantageously employed by evaluating the function $F(M, n'_{max})$ in step 506:

$$F(M, n'_{max}) = \sum_{n=1}^{n=n'_{max}} X\left(\frac{M}{n} + m_a\right) \quad \text{Equation 3}$$

In Equation 3, M is any zero charge mass within the range defined in step 504. The variable $m_a$ is the mass of the adduct ion and X is the distribution function of the signal enhanced mass-to-charge ratio spectrum evaluated in step 503 using equation 1. The function $F(M, n'_{max})$ is used to optimise the value of the maximum charge state. By cycling through $n'_{max}$ in Steps 506 to 508 and evaluating $F(M, n'_{max})$ at different maximum charge states up to $n_{max}$, the maximum value in the function $F(M, n'_{max})$ can be determined. The advantages of this optimisation are two-fold. Firstly, it ensures that the method has the best chance of finding the correct mass of the parent molecule, especially when signal to noise in the input mass-to-charge ratio spectrum is poor. Additionally, it can allow the method to use a fixed but high value of $n_{max}$ thus reducing $n_{max}$ to a constant in the method rather than an experimental or user defined variable.

It will be appreciated that this iterative approach advantageously identifies the most appropriate mass for the parent molecule and can reduce the presence of artefacts in the charge mass spectrum. In high resolution mass spectrometry the person of ordinary skill will understand that charge states can easily be inferred from isotopic separations. However, when using low resolution mass spectrometry data an assumption about the maximum charge state ($n_{max}$) needs to be made in order to extract the parent mass effectively. This can be problematic if the estimate is too high and this can be readily understood with reference to FIGS. 15 through 18 which illustrate a very simplistic example of a multiply charged mass spectrum of a parent molecule with mass M=900.

In this example, the maximum charge ($n_{max}$) is set to 3 and if F(M) were evaluated per prior art techniques based on a simple addition of intensities, F(M) would correspond to a value of 15 (i.e. 3 peaks each at an intensity of 5).

In the event that $n_{max}$ is set too high, for example at $n_{max}$=6 (per FIG. 16A) then this could have an effect of introducing artefact peaks (with similar magnitudes to the real peak at M=900) appearing in the zero charge mass. With simple summation of intensities an output of F(M)≈15.4 can be produced at two values of M, at 900 and 1800 (per FIG. 16B). In addition, a value of $n_{max}$ that is too high can lead to superfluous sampling of noise from the baseline.

It will therefore be appreciated that absent the present teaching and using a technique that employed simple addition of the intensities to calculate F(M), the resultant computation would only lead to an increase in the sampling of baseline noise as $n_{max}$ increases. This will then lead to an increase in the magnitude of false/artefact peaks in the zero charge mass spectrum. Given the application of the technique of the present invention to low resolution mass spectrometry data where the original mass-to-charge ratio spectrum may well be particularly noisy, this only compounds the problem of analysing these spectra. It will therefore be appreciated that estimating $n_{max}$ too high will lead to artefact peaks and estimating $n_{max}$ too low may result in missing the correct mass value of the parent molecule (M).

Figure 17:
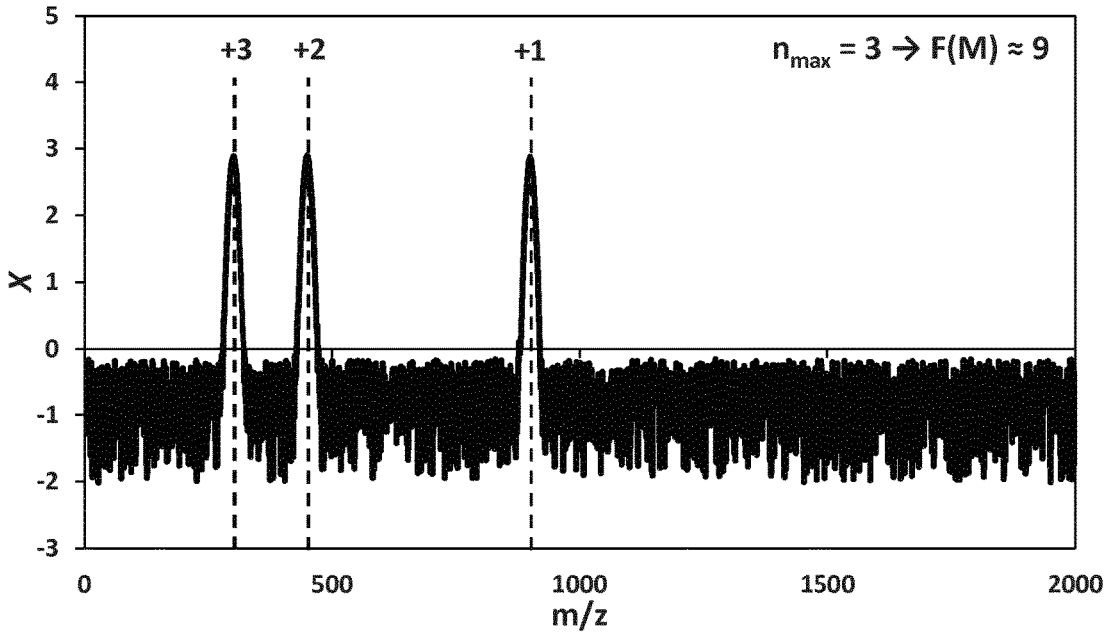
FIG. 17 is an example of the effect of application of using the log of a mean centred data set of the data of FIG. 15 to create a signal enhanced mass-to-charge ratio spectrum.

Cognizant of these potential issues arising from incorrectly attributing values to $n_{max}$, the present inventor has realised that by using the log of the mean centred spectrum—per equation 1 above—that sections of noise or areas between peaks will be negative and oversampling of these will reduce the maximum value of F(M). As shown in FIG. 17, if one considers the example of the same simplified spectrum shown in FIG. 15 but instead uses a transformation per equation 1 with $n_{max}$=3, then the equivalent F(M) value is approximately 9 as opposed to 15.4. The heights of these peaks are reduced relative to the comparable results of FIG. 15 but are still readily identifiable.

Figure 18A:
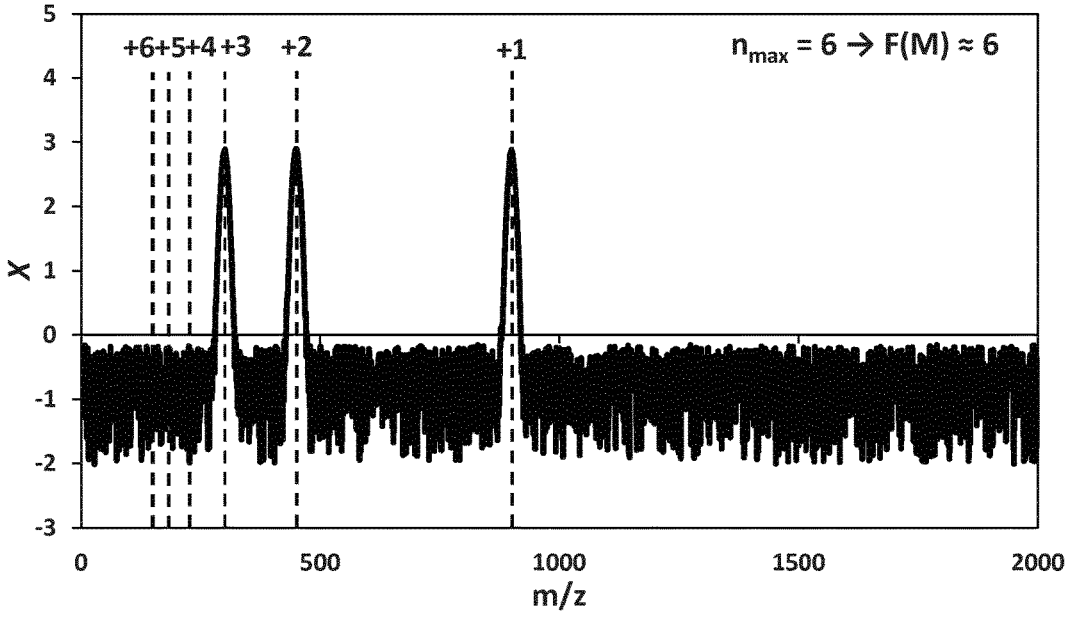
FIG. 18A and FIG. 18B show the effect of using a transformation to the signal enhanced mass-to-charge ratio spectrum of FIG. 17 in computation of a range of charge mass values.
Figure 18B:
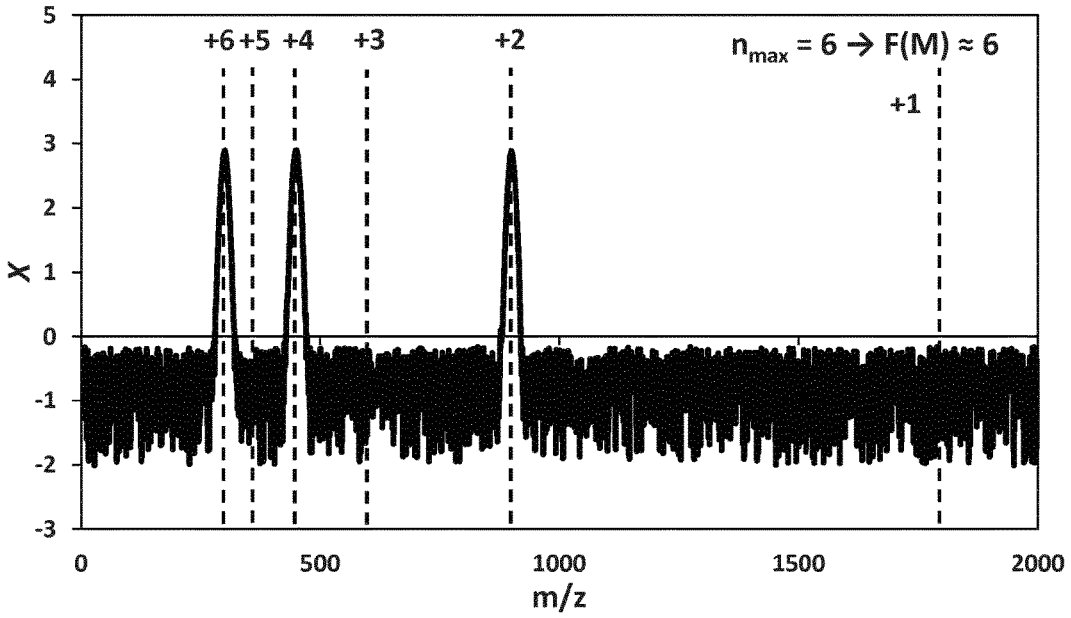

The significance of the technique of the present invention is more readily apparent with the example of setting $n_{max}$ too high at $n_{max}$=6 for M=900 with the resultant artefact at M=1800. As is shown in FIGS. 18A and 18B, the F(M) result per the present teaching is approximately 6 as opposed to a corresponding prior art technique which would have provided F(M) approximately at 15.4. As can be seen if using the transformation to the signal enhanced mass-to-charge ratio spectrum (Equation 1) and $n_{max}$ is too high this leads to a reduction in the maximum value of F(M) as opposed to what is seen for a simple summation. It is therefore possible to look for the maximum value of F(M) by cycling through $n_{max}$ in steps 506, 507 and 508 and outputting the charge spectrum where $n_{max}$ corresponds to the highest value of F(M). This is advantageous over the prior art techniques in that an initial estimate of $n_{max}$ and further optimisation by the user does not need to be made. The value of $n_{max}$ can initially be fixed as constant and at an arbitrarily high value. The value of $n_{max}$ can then be optimised to obtain the correct mass of the parent molecule. As shown with reference to the examples of FIGS. 15 and 16, this optimisation is not possible using simple addition of the raw mass-to-charge ratio spectrum. Since this optimisation in steps 506, 507 and 508 involves summing all the data points over multiple charge states to create 2D arrays, often with thousands of elements, this represents a complex computation that requires computing resources such as those that will be described below with reference to FIG. 14.

Figure 19:
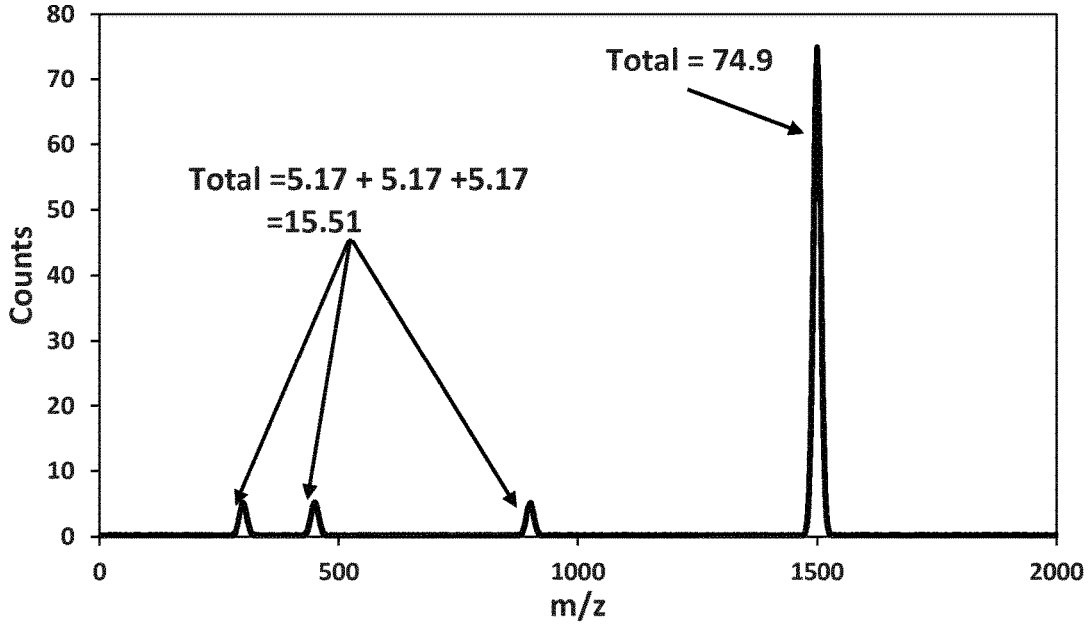
FIG. 19 shows a spectrum similar to that of FIG. 15 with addition of a single impurity.
Figure 20A:
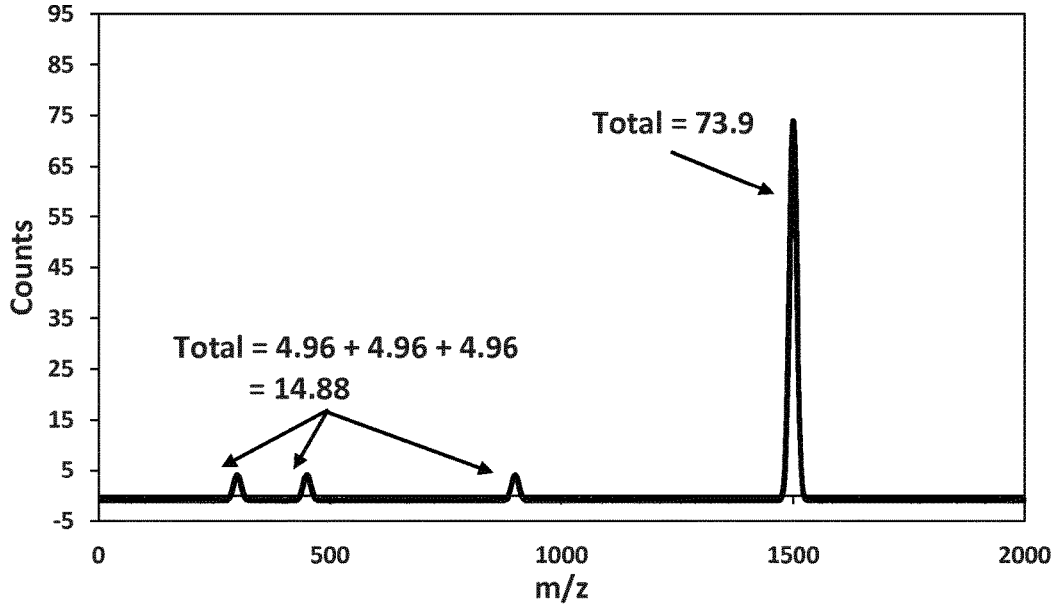
FIG. 20A shows the effect of processing the data of FIG. 19 using a simple subtraction of noise.
Figure 20B:
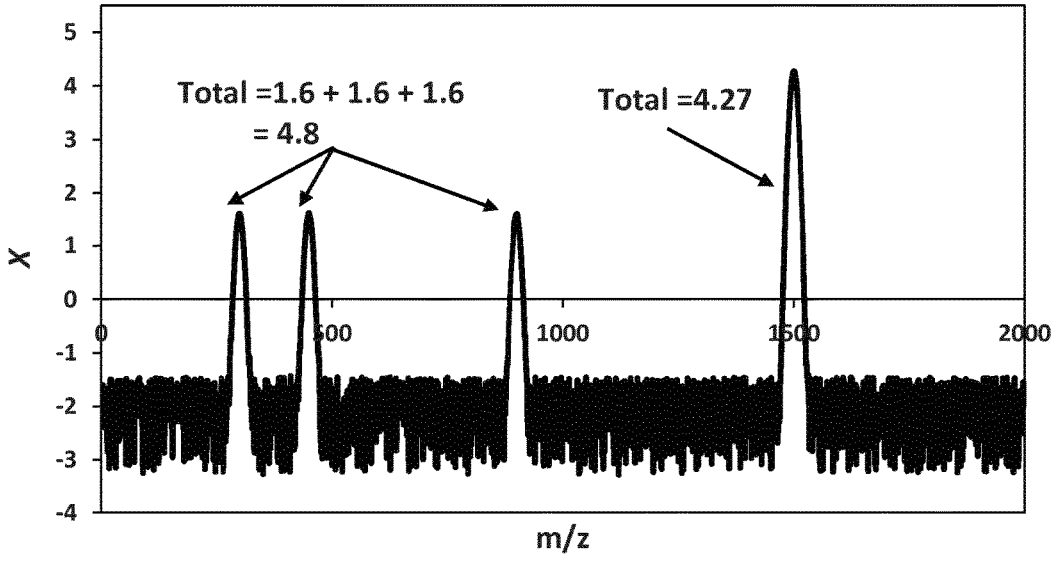
FIG. 20B shows the effect of processing the data of FIG. 19 with a quotient and log function.

It will be appreciated that the determination of $n'_{max}$ where $F(M, n'_{max})$ is at a maximum makes uses of a logarithmic analysis of an averaged spectrum—the computation of Equation 1 above. Use of the quotient and log ensures that a few very intense peaks do not unduly influence the end result. It will be appreciated that experimental mass spectra quite often include intense peaks resulting from adducts or impurities. Use of this quotient and log function ensures that a collection of peaks, as would occur with a multiply charged molecule, have more influence than a single intense peak which the present inventor has realised would not be possible using simple subtraction techniques such as those where an averaged or normalised spectrum data set was subtracted from a raw data sample. This is evident from an extension of the data of the simplified mass-to-charge ratio spectrum of FIG. 15 above. In this extension, shown in FIG. 19 a single intense impurity peak at m/z=1500, which is unrelated to the parent mass of interest at M=900 (m/z=900, 450 and 300), is added to as to exemplify the type of impurity data that can be present in a typical mass spectrum. In this example the data in FIG. 19 represents a raw mass-to-charge ratio spectrum with the addition of an impurity at m/z=1500. Here it can be seen that this single peak is much more intense (74.9) than the combined intensity (15.51) of the 3 peaks from the parent molecule at M=900 (m/z=900, 450 and 300). Using a simple subtraction of noise technique results in a data set such as that graphically represented in FIG. 20A where the peak at m/z=1500 remains more intense than the combined intensity of the peaks at m/z=900, 450 and 300. In contrast, using a technique per Equation 1 which advantageously employs a transformation based on a quotient and log function results in the intensity of the impurity peak at m/z=1500 being smaller than the combined intensity of the peaks at m/z=900, 450 and 300 from our parent molecule (M=900).

Once the value of $n'_{max}$ where $F(M, n'_{max})$ is at a maximum has been determined, a zero charge spectrum can be produced in steps 510 and 511. Comparison of these steps with those described with reference to FIG. 1 will confirm that they are identical to steps 107 and 108. Using these techniques, an output per that evident in FIG. 6 may be provided. The example of FIG. 6 shows an application of the method of FIG. 5 on the data set of FIG. 2 and not surprisingly the same peak as FIG. 4 is identified. As was discussed above with reference to FIG. 4, this representation is not limiting as the data may be output in a variety of different forms for example in the form of a table of mass values or simply the output of a single mass value.

It will be appreciated that a function $F(M, n'_{max})$ may be derived from the zero charge Equation 3 for the singly charged case. Following Equation 3a below, the function $F(M, n'_{max})$ may be evaluated so as to output a singly charged spectrum in steps 510 and 511:

$$F(M, n'_{max}) = \sum_{n=1}^{n=n'_{max}} X\left(\frac{M - m_a}{n} + m_a\right). \quad \text{Equation 3a}$$

More generally, it will be appreciated that a function $F(M, n'_{max})$ may be derived for both zero and singly charged spectra. As per Equation 3b below, the function $F(M, n'_{max})$ may be evaluated so as to output zero or singly charged spectra in steps 510 and 511:

$$F(M, n'_{max}) = \sum_{n=1}^{n=n'_{max}} X\left(\frac{M - zm_a}{n} + m_a\right). \quad \text{Equation 3b}$$

It will be apparent that when z is equal to 0, the function $F(M, n'_{max})$ of Equation 3b reverts to the zero charge function of Equation 3; and the singly charged function in Equation 3a may be obtained from the general function of Equation 3b with z is equal to 1.

Figure 5:
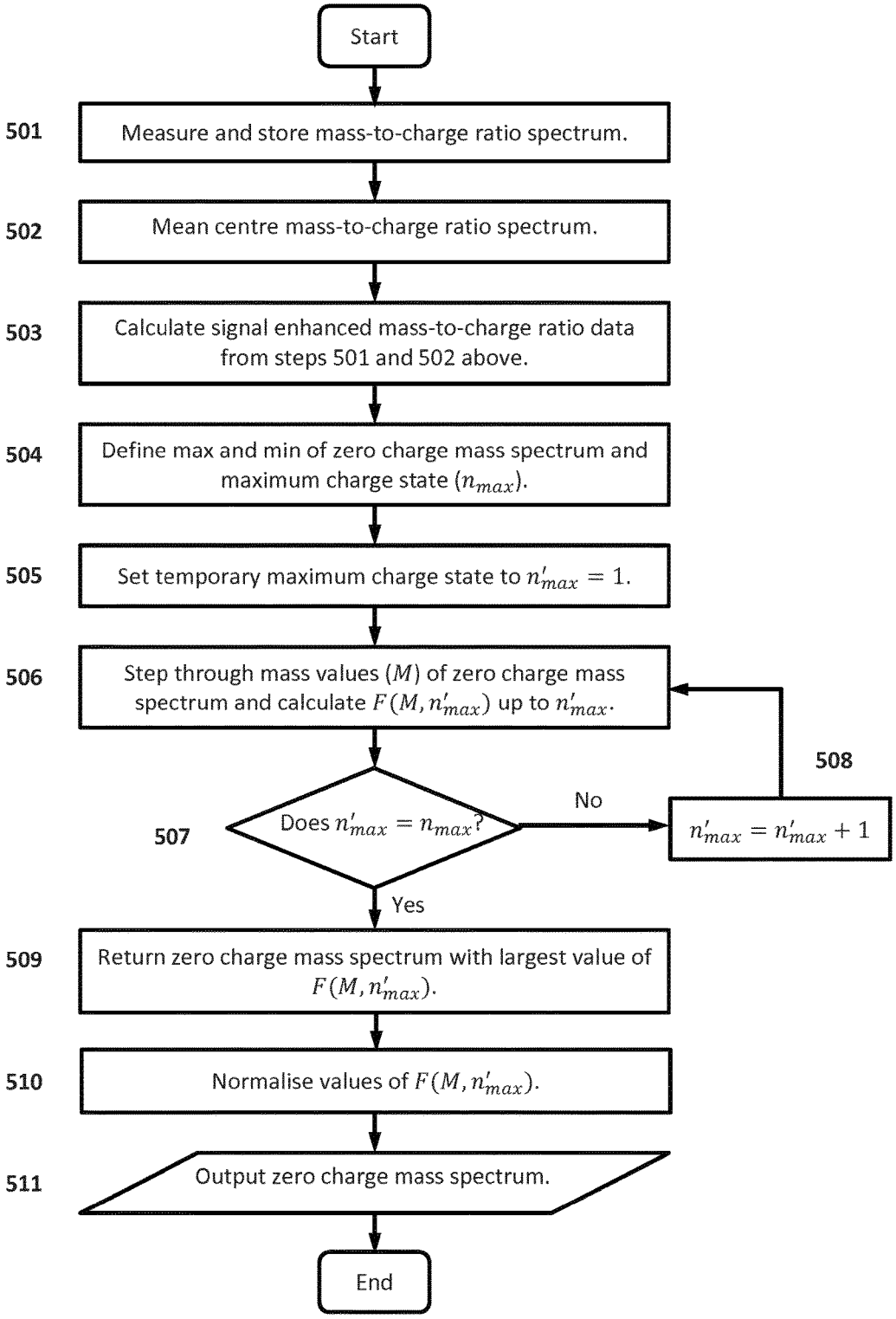
FIG. 5 is a flowchart of steps used in a modification of the method of FIG. 1 in accordance with a second aspect of the present teaching.
Figure 6:
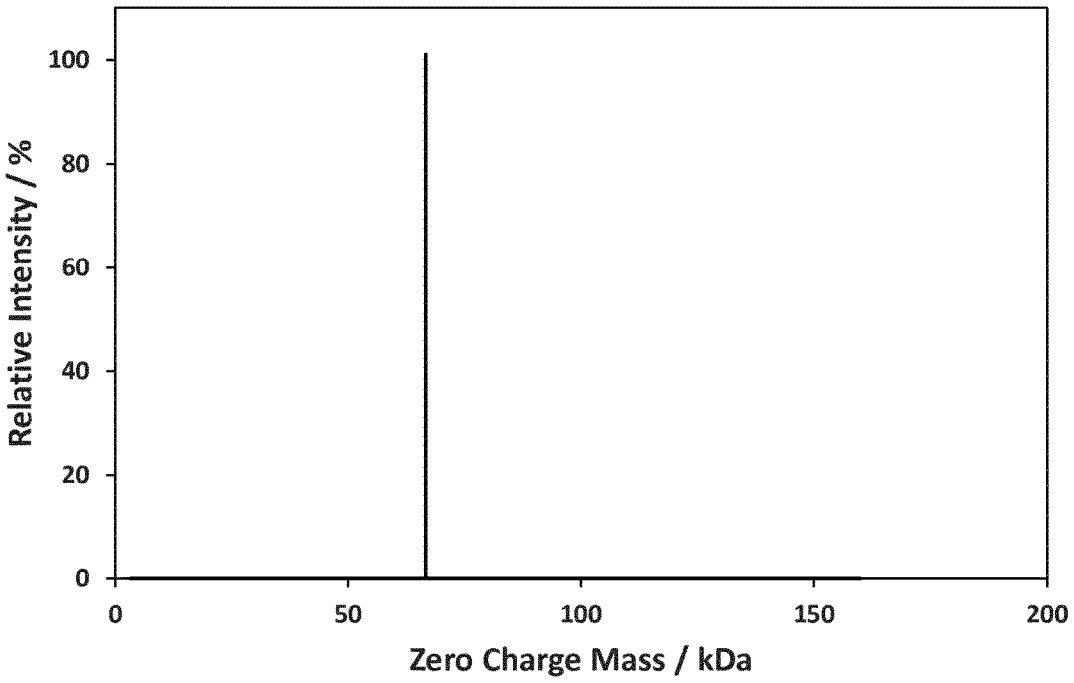
FIG. 6 is an example of a zero charge spectrum generated using the method of FIG. 5 on data presented in FIG. 2.

While the techniques of FIG. 1 and FIG. 5 when applied to the data set of FIG. 2 provide a similar output, the present inventor has realised that further modification to these techniques in the form of additional pre-processing of the data set may be employed. An example of this modification to that heretofore described will be presented with reference to the sequence of steps in the flowchart of FIG. 7. In this methodology, which shares processing techniques described above with reference to FIG. 5, two additional steps—steps 702 and 703—are employed. By including these steps in the technique described above with reference to FIG. 5, an enhanced method of extraction of mass information from the original mass-to-charge ratio spectrum is provided. This technique employing these pre-processing steps is particularly beneficial in the extraction of the parent molecule mass from mass-to-charge ratio spectra with poor signal to noise, for example the mass-to-charge ratio spectrum of bovine serum albumin shown in FIG. 8. Comparison of this data set with the data of FIG. 2 shows that it suffers from lower ion count levels than the data set of FIG. 2 and is therefore more susceptible to errors from inherent noise levels. When provided with a data set such as that shown in FIG. 8, the present teaching employs a pre-processing smoothing step (Step 702) to eliminate noise in the spectrum but which also maintains peak structure. In a preferred arrangement, a Savitzky-Golay filter is used as this filter is very good at preserving the shape of the original features in the mass-to-charge ratio spectrum.

Figure 8:
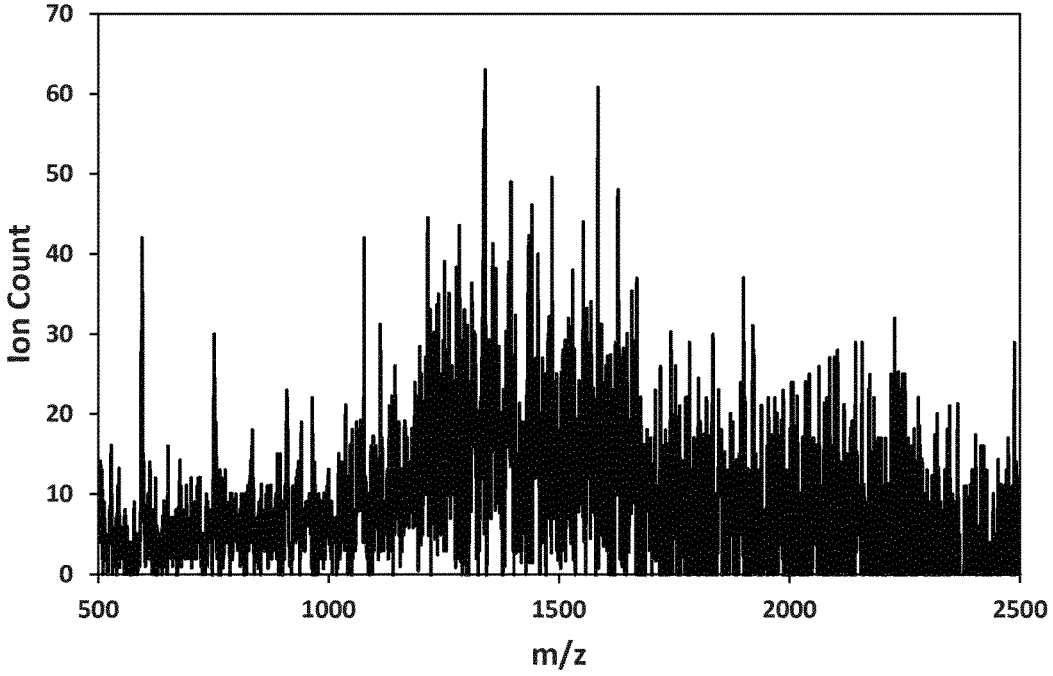
FIG. 8 is a mass-to-charge ratio spectrum of bovine serum albumin with very poor signal to noise.
Figure 9:
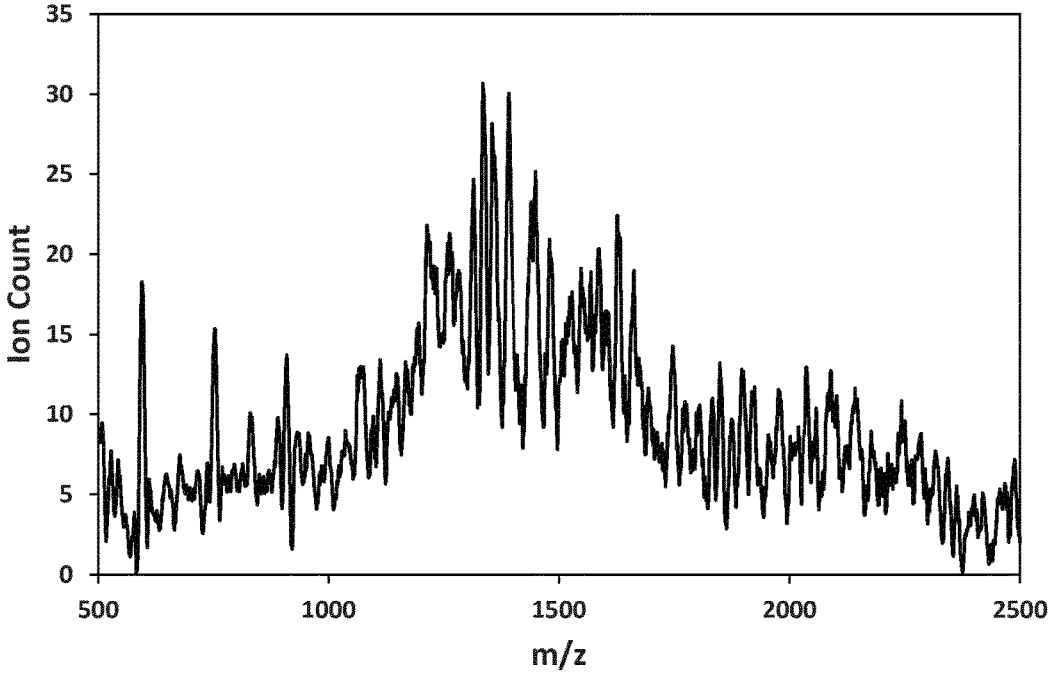
FIG. 9 is an example of the implementation of step 702 on the data in FIG. 8.

Other moving average smoothing methods or exponential smoothing methods can also be utilised. FIG. 9 demonstrates the use of this pre-processing smoothing on the spectrum of FIG. 8, from which it will be evident that a "cleaner" data set can be generated.

Figure 7:
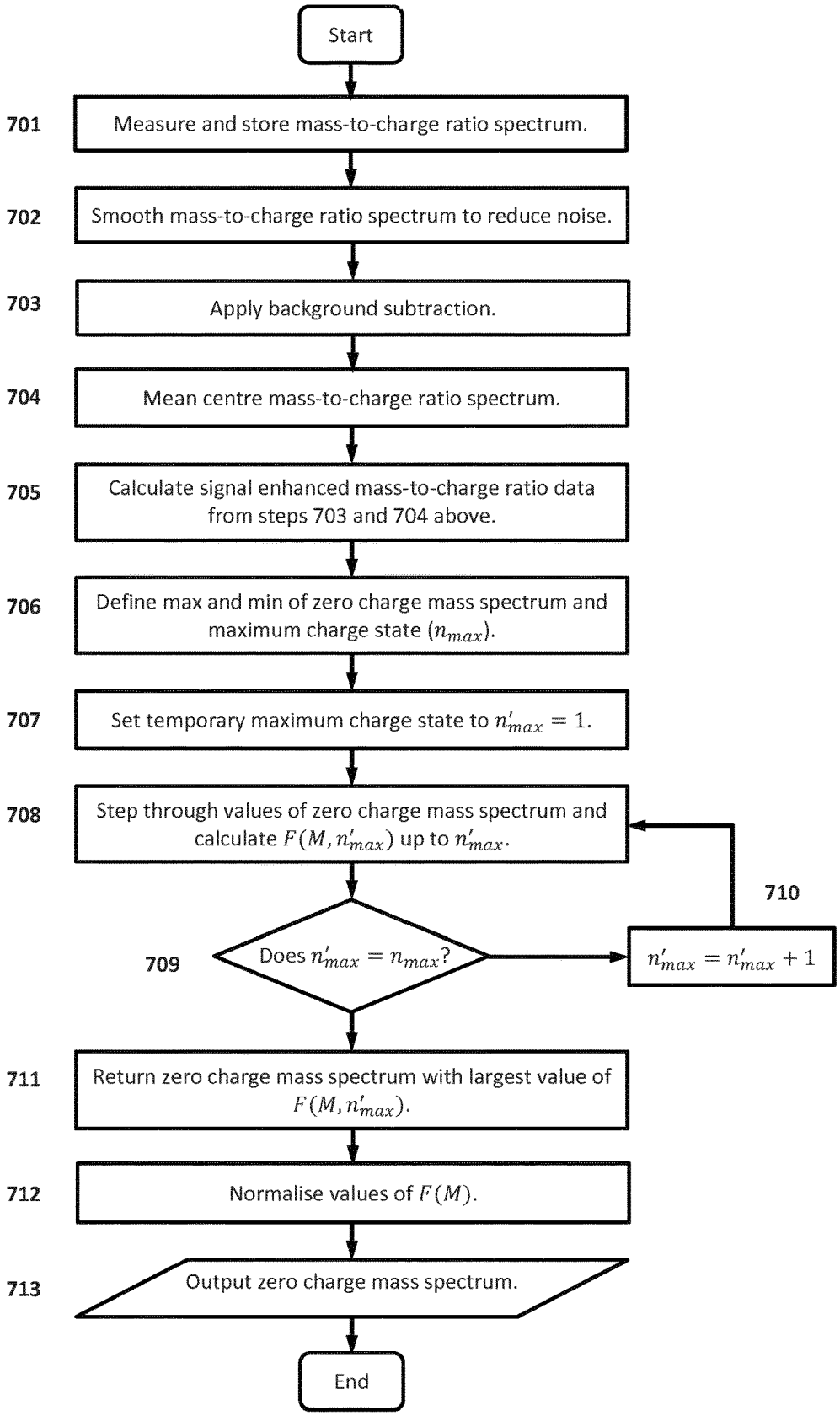
FIG. 7 is a flowchart of steps used in another modification to the method of FIG. 1.
Figure 10:
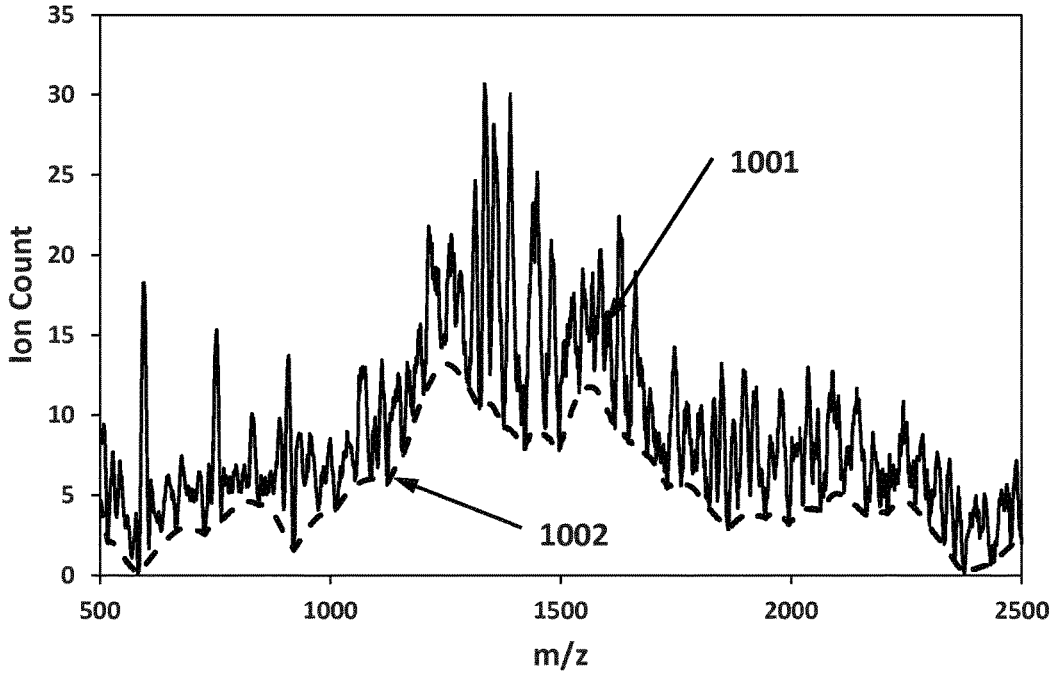
FIG. 10 shows the implementation of step 703 on the smoothed data in FIG. 9.

Using this filtered data set from FIG. 9, the method of FIG. 7 then provides an additional processing step—background subtraction—per Step 703. While a variety of baseline subtraction techniques such as convex hull, wavelets, and median filters could be utilised, in a preferred aspect a statistics-sensitive non-linear iterative peak clipping (SNIP) baseline subtraction such as that demonstrated in Nucl. Instrum. Meth. B, vol. 34, 396-402 (1998) is used. It will be appreciated by those of ordinary skill in mass spectrometry that SNIP is widely used in mass spectrometry as it has a demonstrated capacity to cope with a large variety of background shapes. FIG. 10 demonstrates the use of this baseline subtraction on the smoothed data presented in FIG. 9. It will be appreciated that the use of the baseline subtraction generates a smoothed mass-to-charge ratio spectrum 1002 relative to the originating bovine serum albumin spectrum 1001 of FIG. 9.

It will be appreciated that the baseline subtraction step (703) does not have to follow the smoothing step, Step 702 and other techniques could employ baseline subtraction as a pre-processing step to the smoothing step (702). Alternative techniques could also utilise either baseline subtraction or smoothing in isolation.

Figure 11:
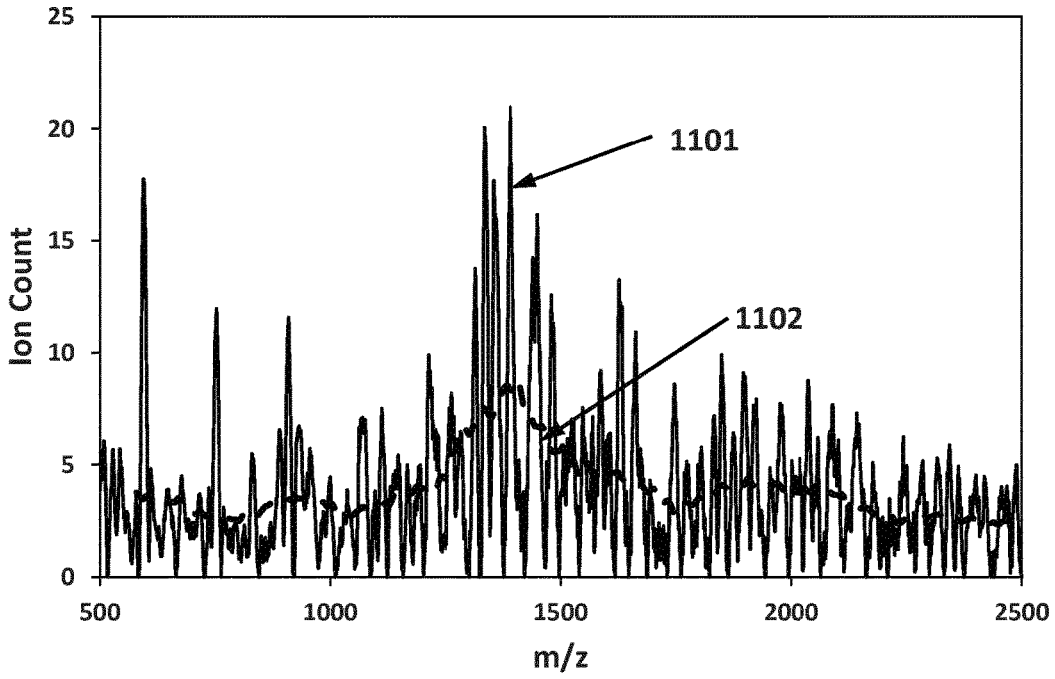
FIG. 11 is an example of the implementation of step 704 on the data in FIG. 10.

After steps 701 to 703 the pre-processed spectrum is mean centred in step 704 in a method identical to that outlined in step 102 and step 502 of FIG. 1 and FIG. 5 respectively. FIG. 11 demonstrates the effect of this step on the pre-processed data in FIG. 10. The pre-processed mass-to-charge ratio spectrum 1001 of bovine serum albumin described previously with respect to FIG. 10 is represented in FIG. 11 by 1101 and 1102 represents the processing of that data set using the mean centred data techniques of Step 704.

Figure 12:
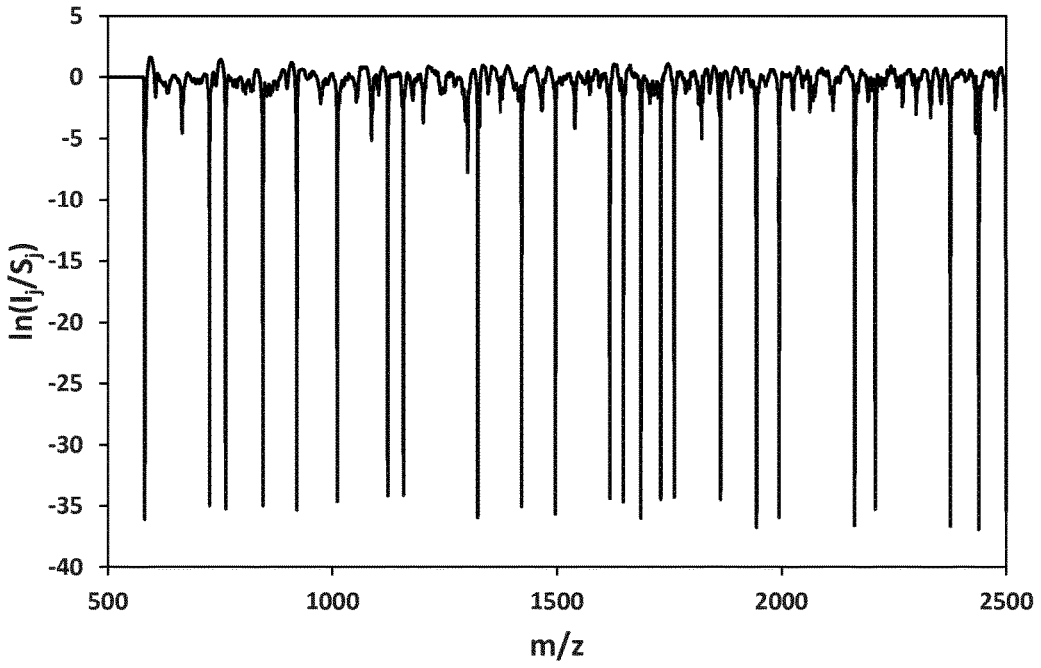
FIG. 12 demonstrates the implementation of step 705 on the data in FIG. 11.

Following step 704 in step 705 the signal enhanced mass-to-charge ratio spectrum is evaluated using equation 1 in a method identical to steps 103 and 503 as described above. FIG. 12 shows this output when applied to the data presented in FIG. 11.

In steps 706 to 712 the signal enhanced mass-to-charge ratio spectrum is evaluated using the function in equation 3 in a manner identical to steps 504 to 510 outlined above.

Figure 13:
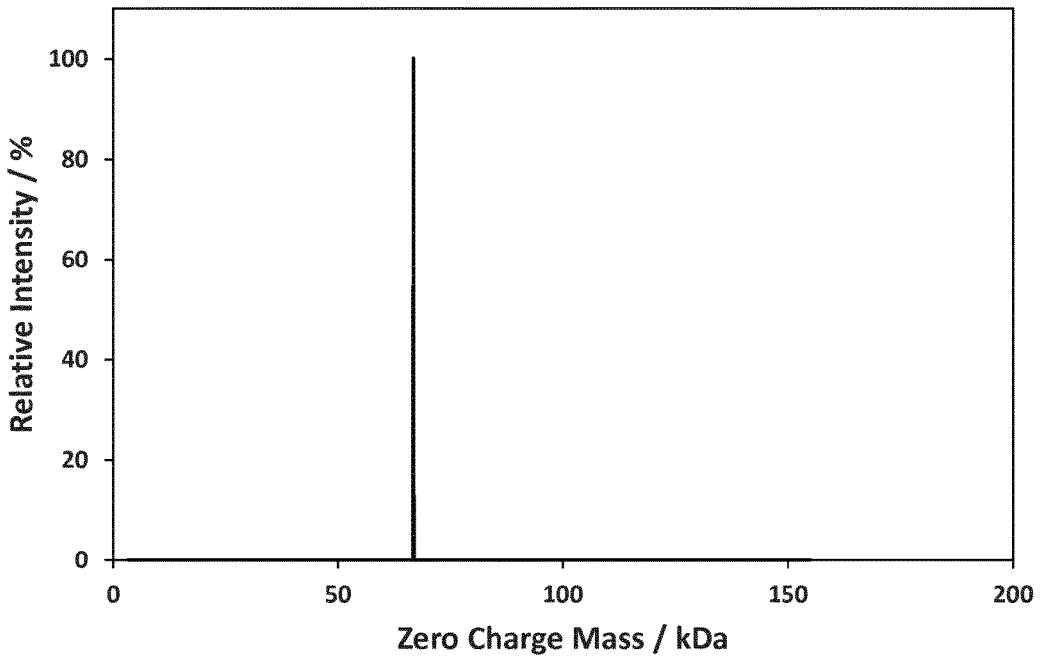
FIG. 13 is an example of a zero charge spectrum generated using the method of FIG. 7 on data presented in FIG. 8.

In step 713 a zero charge spectrum is produced. FIG. 13 demonstrates this output when the techniques of FIG. 7 are employed on a noisy data set such as that shown in FIG. 8. Similarly to the representations of FIG. 4 and FIG. 6, this representation of data in a graph form is not limiting and in alternative arrangements this output could be presented as a table of mass values or a single mass value.

It will be appreciated that, in step 706, the signal enhanced mass-to-charge ratio spectrum may be evaluated using either the function in Equation 3a or Equation 3b in a manner identical to that outlined above with respect to steps 504 to 510. It will be appreciated that choice of the specific equation will respectively produce a zero or singly charged spectrum at step 713.

Figure 14:
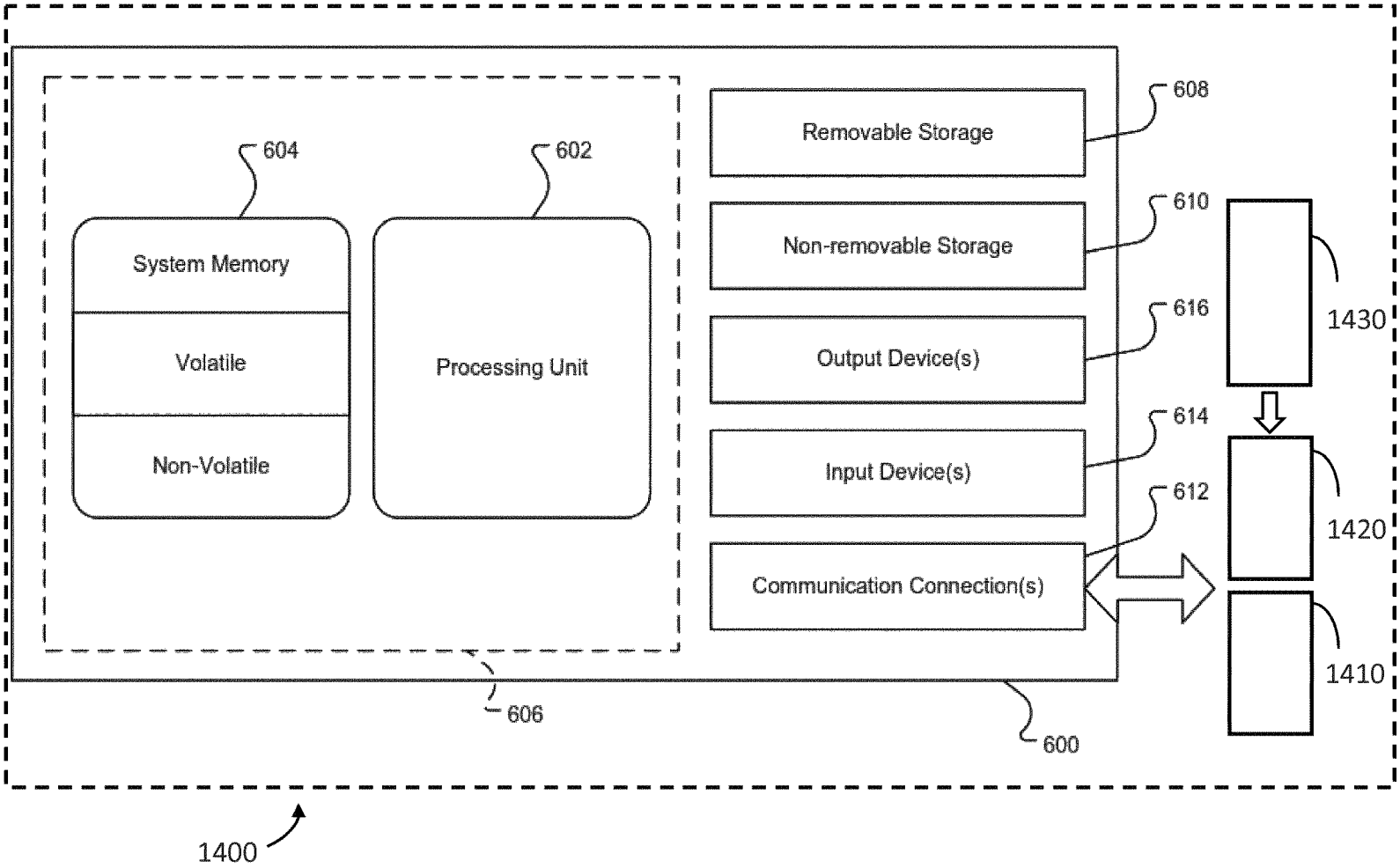
FIG. 14 is an example of a computer processing device that may be employed within the context of the present teaching to implement the method of any one of FIG. 1, 5 or 7.
Figure 15:
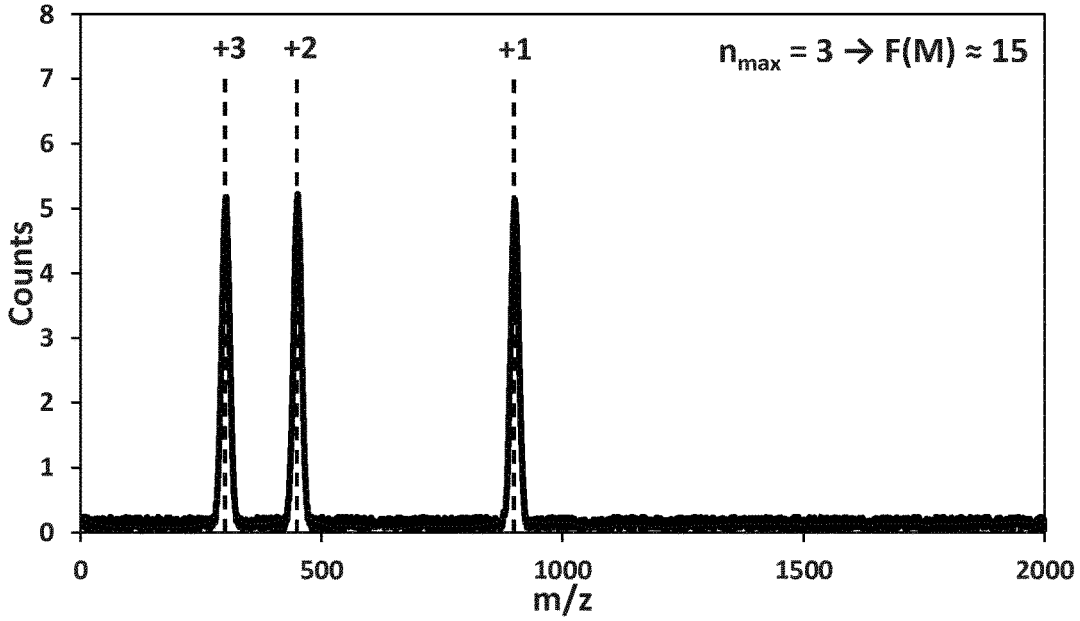
FIG. 15 is an example of an idealised mass spectrum identifying three charge peaks.
Figure 16A:
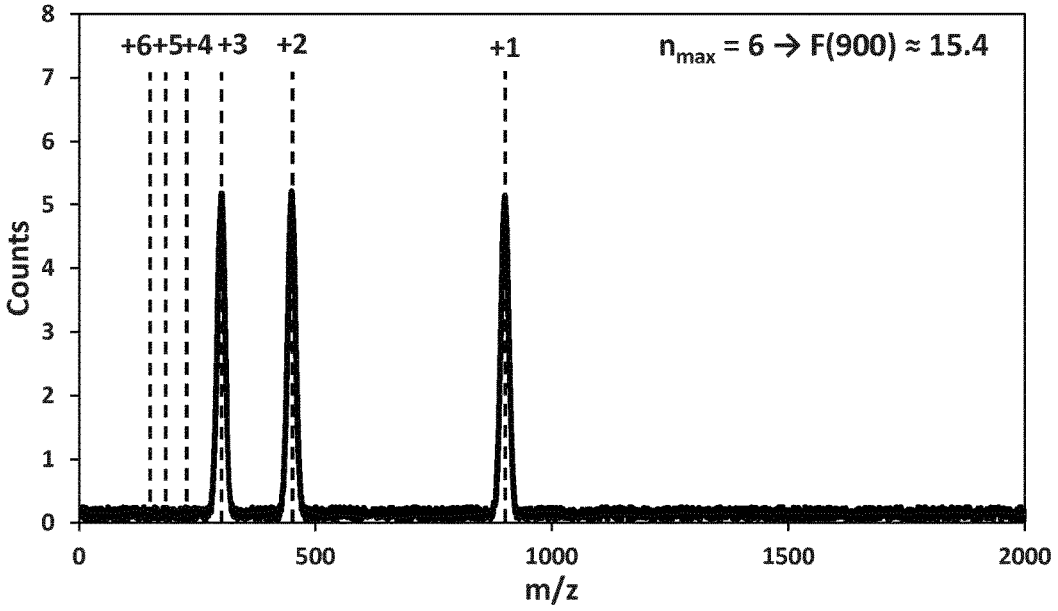
FIG. 16A and FIG. 16B show the effect of a summation technique in computation of a range of charge mass values for the data of FIG. 15.
Figure 16B:
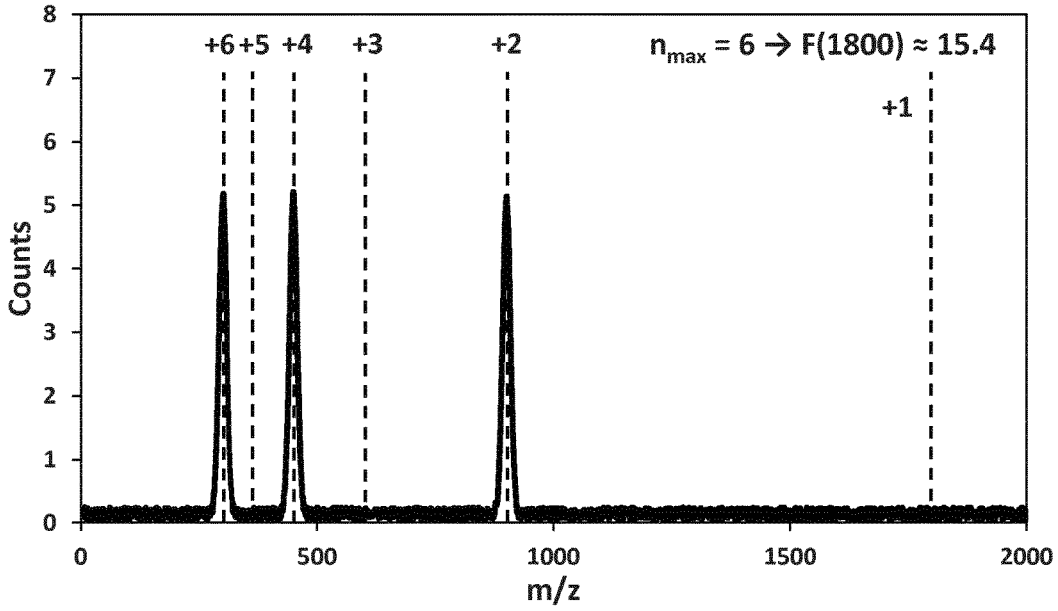

As discussed above, a method in accordance with the present teaching uses a data set that is generated by a mass spectrometer and the functionality of the present teaching may be integrated with existing functionality of such mass spectrometers. Examples of the functionality of known mass spectrometers that may be usefully employed within the present teaching include those described in our earlier applications such as EP 1865533 or EP 2372745. Using these types of mass spectrometers, it is possible in accordance with the present teaching to extend their functionality by integration or coupling of additional processing to same. An example of such integration is shown in FIG. 14 where a mass spectrometer 1400 includes an ionisation source 1430, which may be an electrospray ionisation source. The ionisation source is configured to ionise a polyatomic parent molecule which when detected by a detector 1420 produce the input mass-to-charge ratio spectrum discussed above. The input mass-to-charge ratio spectrum is then relayed to a computer system or other processing device 600. In one implementation, the processing device 600 typically includes at least one processing unit 602 and memory 604. Depending upon the exact configuration and type of the processing device 600, the memory 604 may be volatile (e.g., RAM), non-volatile (e.g., ROM and flash memory), or some combination of both. The most basic configuration of the processing device 600 need include only the processing unit 602 and the memory 604 as indicated by the dashed line 606. A primary or base operating system is configured to control the basic functionality of the processing device 600 in the non-volatile memory 604.

The processing device 600 may further include additional devices for memory storage or retrieval. These devices may be removable storage devices 608 or non-removable storage devices 610, for example, memory cards, magnetic disk drives, magnetic tape drives, and optical drives for memory storage and retrieval on magnetic and optical media. Storage media may include volatile and non-volatile media, both removable and non-removable, and may be provided in any of a number of configurations, for example, RAM, ROM, EEPROM, flash memory, CD-ROM, DVD, or other optical storage medium, magnetic cassettes, magnetic tape, magnetic disk, or other magnetic storage device, or any other memory technology or medium that can be used to store data and can be accessed by the processing unit 602. Additional instructions, e.g., in the form of software, that interact with the base operating system to create a special purpose processing device 600, in this implementation, instructions for the processing of mass spectrometer data received from a mass spectrometer detector 1420 in the form of a data array, may be stored in the memory 604 or on the storage devices 610 using any method or technology for storage of data, for example, computer readable instructions, data structures, and program modules.

The processing device 600 may also have one or more communication interfaces 612 that allow the processing device 600 to communicate with other devices, such as for example the mass spectrometer. The communication interface 612 may be connected with a network. The network may be a local area network (LAN), a wide area network (WAN), a telephony network, a cable network, an optical network, the Internet, a direct wired connection, a wireless network, e.g., radio frequency, infrared, microwave, or acoustic, or other networks enabling the transfer of data between devices. Data is generally transmitted to and from the communication interface 612 over the network via a modulated data signal, e.g., a carrier wave or other transport medium. It will be appreciated that a modulated data signal is an electromagnetic signal with characteristics that can be set or changed in such a manner as to encode data within the signal. In this way, while the arrangement of FIG. 14 shows the full integration within the dashed outline 1400, the functionality of the processing 600 may be done remotely from the actual detector 1420 and ionisation source 1430.

The processing device 600 may further have a variety of input devices 614 and output devices 616. Exemplary input devices 614 may include a video camera, recorder, or playback unit, a keyboard, a mouse, a tablet, and/or a touch screen device. Exemplary output devices 616 may include a video display, audio speakers, and/or a printer. Such input devices 614 and output devices 616 may be integrated with the computer system 600 or they may be connected to the computer system 600 via wires or wirelessly, e.g., via IEEE 802.11 or Bluetooth protocol. These input and output devices may be in communication with or integrated with a user interface 1410 for the mass spectrometer. These integrated or peripheral input and output devices are generally well known and are not further discussed herein. Other functions, for example, handling network communication transactions, may be performed by the operating system in the non-volatile memory 604 of the processing device 600.

The words comprises/comprising when used in this specification are to specify the presence of stated features, integers, steps or components but does not preclude the presence or addition of one or more other features, integers, steps, components or groups thereof.

The method described herein may be implemented as logical operations and/or modules in one or more systems that are coupled to or in electronic communication with a mass spectrometer or mass spectrometer components. The logical operations may be implemented as a sequence of processor-implemented steps executing in one or more computer systems and as interconnected machine or circuit modules within one or more computer systems.

Likewise, the descriptions of various component modules may be provided in terms of operations executed or effected by the modules. The resulting implementation is a matter of choice, dependent on the performance requirements of the underlying system implementing the described technology. Accordingly, the logical operations making up the embodiments of the technology described herein are referred to variously as operations, steps, objects, or modules. Furthermore, it should be understood that logical operations may be performed in any order, unless explicitly claimed otherwise or a specific order is inherently necessitated by the claim language.

In some implementations, articles of manufacture are provided as computer program products that cause the instantiation of operations on a computer system to implement the invention. One implementation of a computer program product provides a non-transitory computer program storage medium readable by a computer system an encoding a computer program. It should further be understood that the described technology may be employed in special purpose devices independent of a personal computer. The above specification, examples and data provide a complete description of the structure and use of exemplary embodiments of the invention as defined in the claims.

Although various embodiments and aspects of the claimed invention have been described above with a certain degree of particularity, or with reference to one or more individual embodiments, those skilled in the art could make numerous alterations to the disclosed embodiments without departing from the spirit or scope of the claimed invention. Other embodiments are therefore contemplated. It is intended that all matter contained in the above description and shown in the accompanying drawings shall be interpreted as illustrative only of particular embodiments and not limiting. Changes in detail or structure may be made without departing from the basic elements of the invention as defined in the following claims.

The invention claimed is:

1. A method for extracting mass information from low resolution mass-to-charge ratio spectra of multiply charged species to identify a mass of a polyatomic parent molecule within the multiply charged species, the method comprising the steps of:

receiving from a mass spectrometer a data set indicative of a population of multiply charged ions, the number of charges on each ion defining the charge state of that ion, wherein a sub-population of ions within said population of ions comprises ions of said population of ions having a same charge state;

using the data set indicative of a population of multiply charged ions to produce an input mass-to-charge ratio spectrum, the sub-populations of each charge state being represented by intensities in the mass-to-charge ratio spectrum;

processing the input mass-to-charge ratio spectrum to provide a signal enhanced mass-to-charge ratio spectrum, the signal enhanced mass-to-charge ratio spectrum being generated from a logarithm of the quotient of said mass-to-charge ratio spectrum and a smoothed representation of said mass-to-charge ratio spectrum;

identifying a range of defined charged mass values of a defined charged mass spectrum within which to search for a mass of the polyatomic parent molecule;

generating for each mass within said range of defined charged mass values a summation equal to the addition of values in the signal enhanced mass-to-charge ratio spectrum that correspond to said mass at sequential charge states up to a maximum charge state using the function:

$$F(M) = \sum_{n=1}^{n=n_{max}} X\left(\frac{M - zm_a}{n} + m_a\right)$$

Where M is any defined mass within said range of defined charged mass values; $m_a$ is the mass of the charge carrying adduct; z is the order of the defined charged mass spectrum and X is a distribution function of the signal enhanced mass-to-charge ratio spectrum; and using said summation values to determine the mass of a polyatomic parent molecule.

2. The method of claim 1 wherein using said summation values to determine the mass of a polyatomic parent molecule comprises normalizing the values from said summations across the range of summations to determine the mass of the parent molecule.

3. The method of claim 1 wherein the mass of the charge carrying adduct, $m_a$, is set to equal one, representing a proton mass.

4. The method of claim 1 wherein the signal enhanced mass-to-charge ratio spectrum (103) is generated from the function:

$$X_j = \ln\left(\frac{I_j}{S_j}\right)$$

where X represents the signal enhanced mass-to-charge ratio spectrum, I corresponds to an intensity in the input mass-to-charge ratio spectrum (201) and S is a smoothed representation of the input mass-to-charge ratio spectrum.

5. The method of claim 1, where for each mass within the defined range of defined charged mass values, the method further comprises:

calculating summations up to differing values of a maximum charge state;

using of the values from said summations up to different values of the maximum charge state to determine the molecular weight of the parent molecule.

6. The method of claim 1 further comprising spectral pre-processing of the input mass-to-charge ratio spectrum prior to forming the signal enhanced mass-to-charge ratio spectrum.

7. The method of claim 6 wherein the spectral pre-processing is selected from at least one of smoothing and/or baseline subtraction.

8. The method of claim 1 where the multiply charged species are generated by electrospray ionisation.

9. The method of claim 1 comprising ionising a polyatomic parent molecule within a mass spectrometer source to produce the input mass-to-charge ratio spectrum.

10. The method of claim 1 wherein the defined charge mass spectrum is a zero charge mass spectrum with all identified species having a zero charge value.

11. The method of claim 1 wherein the defined charge mass spectrum is a singly charged mass spectrum used to identify a range of singly charged mass values.

12. A mass spectrometer comprising an electrospray ionisation source and a detector, the detector configured to generate an output indicative of a population of multiply charged ions generated by the ionisation source, the number of charges on each ion defining the charge state of that ion, each charge state consisting of a sub-population of ions within said population of ions, the spectrometer further comprising a processor configured to carry out the method of any one of claims 1 to 11.

* * * * *